United States Patent [19]

Adamek et al.

[11] Patent Number: 4,879,015

[45] Date of Patent: Nov. 7, 1989

[54] METHOD AND MANUAL APPARATUS FOR THE SEMIMECHANICAL GALVANIZING OF SHEET METAL SURFACES

[75] Inventors: Jan Adamek, Rutesheim; Karl-Heinz Schaich, Kornwestheim; Wolfgang Heck, Renningen, all of Fed. Rep. of Germany

[73] Assignee: Dr. Ing. h.c.f. Porsche Aktiengesellschaft, Stuttgart, Fed. Rep. of Germany

[21] Appl. No.: 97,716

[22] Filed: Sep. 17, 1987

Related U.S. Application Data

[63] Continuation-in-part of Ser. No. 836,368, Mar. 5, 1986, abandoned.

[30] Foreign Application Priority Data

Mar. 6, 1985 [DE] Fed. Rep. of Germany ..... 3507927

[51] Int. Cl.[4] ..... C25D 5/06

[52] U.S. Cl. ..... 204/224 R; 204/15

[58] Field of Search ..... 204/15, 224 R, 271, 204/275

[56] References Cited

U.S. PATENT DOCUMENTS

| | | | |
|---|---|---|---|
| 2,961,395 | 11/1960 | Icxi | 204/224 |
| 3,751,343 | 8/1973 | Macula et al. | 204/15 |
| 4,159,934 | 7/1979 | Kadija | 204/224 R |
| 4.304,654 | 12/1981 | Norris | 204/212 |
| 4,632,740 | 12/1986 | Operschall et al. | 204/129.46 |

FOREIGN PATENT DOCUMENTS 8502869 7/1985 PCT Int'l Appl. .

1070397 6/1967 United Kingdom .

*Primary Examiner*—John F. Niebling
*Assistant Examiner*—William T. Leader
*Attorney, Agent, or Firm*—Barnes & Thornburg

[57] ABSTRACT

A method and manual apparatus for the semimechanical galvanizing of sheet metal surfaces according to an absorbent covering, which serves for the post-galvanizing of body sheet metal panels within the area of a damage of the zinc layer. According to this method, the surface of the panal is electrocleaned within the area of the damage with an aqueous alkaline solution by an automatic to and fro movement by means of an absorbent covering secured at the hand apparatus. Thereafter, a zinc electrolyte on an alkaline basis is applied by the movement of the hand apparatus by means of a further absorbent covering connected with the hand apparatus with a current of about 10 to 15 A and a voltage of 11 to 13 V and a zinc layer with a thickness of 8 to 12 μm is produced. An apparatus is provided for the semimechanical galvanizing of sheet metal surfaces, which includes a treatment element forming an anode and including cover elements covering the surface of the treatment element for a zinc electrolyte or a cleaning solution. A tool element is operatively connected to the treatment element and a handle element is connected with the tool element for displacing the treatment element on a surface of a standing-still workpiece as a unit. The tool element automatically carries out relative movements of the treatment element with respect to the standing-still workpiece and the tool element.

4 Claims, 1 Drawing Sheet

METHOD AND MANUAL APPARATUS FOR THE SEMIMECHANICAL GALVANIZING OF SHEET METAL SURFACES

BACKGROUND AND SUMMARY OF THE INVENTION

This application is a Continuation-in-Part of U.S. application Ser. No. 836,368, filed March 5, 1986, now abandoned.

The present invention relates to a method and apparatus for galvanizing sheet metal surfaces or the electrolytic depositing of metal on sheet metal surfaces utilizing the absorbent cover-galvanizing process, especially for the post-galvanizing of body panels within the area of a damage of the galvanizing coating by a manufacturing operation.

In the manufacture of motor vehicle bodies, it is necessary during the manufacturing operation to connect galvanized sheet metal panels with each other by welding. During the welding, the galvanized layer is reduced, and additionally the welded places have to be subsequently ground whereby the galvanized layer is also removed in the zones adjoining the welding place.

Manual tools for the manual galvanizing are disclosed in the DE-PS 934,620, by means of which a galvanizing process by manual operation can be carried out only tediously and relatively slowly by reason of the construction thereof and use thereof, for example, in an assembly line manufacture for motor vehicles is not favorable from a cost point of view.

Prior art galvanizing processes according to the absorbent cover-galvanizing principle are known but are not destined optimally for body panels which after galvanizing are additionally subjected to a baking-paint-finishing. It has been found in practice that some known process realizations and composition for galvanizing produced in a disadvantageous manner an unfavorable surface for the painting within the post-galvanizing area.

It is an object of the present invention to provide a process and manual apparatus for post-galvanizing whereby the apparatus for carrying out the process is to be simple in its handling and compact in construction in order to be able to undertake a post-galvanizing operation in a simple manner. In certain preferred embodiments of the invention, the process and apparatus can be used on shaped sheet metal panels in an assembly line manufacture of motor vehicles. Additionally, the galvanization is to be so built up that subsequent paint-baking finish is possible without aftertreatment.

These objects are achieved according to the present invention by providing a process in which the surface of the sheet metal part within the area of the damage is electro-cleaned with an aqueous alkaline solution having a pH value of about 13 by means of a absorbent covering by an automatic to and fro movement. Further, a zinc electrolyte on an alkaline basis (pH value of 8) is thereafter applied by means of a further absorbent covering by an automatic to and fro movement with a current strength of about 10 to 15 at a voltage of 11 to 13 V. A galvanized layer with a thickness of 8 to 12 $\mu$m is produced within a period of time of two to three minutes.

These objects are achieved according to the present invention by providing an apparatus for semimechanical galvanizing of sheet metal surfaces including a treatment element forming an anode and including cover elements covering the surface thereof for a zinc electrolyte or cleaning solution. Also, included are tool elements operatively connected to the treatment element. Handle elements are connected with the tool elements for displacing the treatment element on a surface of a standing-still workpiece as a unit. The tool elements automatically carry out relative movements of the treatment element with respect to the standing-still workpiece and the tool elements. This apparatus is used in the novel post-galvanizing process. This apparatus can be handled in a simple manner, and the work can be done relatively rapidly. It is also possible to move the entire manual apparatus including the attached tool and treatment element by a free manual movement.

According to other advantageous features of certain preferred embodiments of the invention, the apparatus can also be used for cleaning the surface prior to the galvanizing operation. For that purpose, the treatment element for galvanizing is exchanged with a treatment element for cleaning or two hand apparatus with corresponding treatment elements are used.

According to other advantageous features of certain preferred embodiments of the invention, the longitudinal and transverse grooves which are arranged in the working surface of the treatment element extend preferably over the entire surface so that a uniform delivery of zinc electrolyte to the absorbent covering is assured.

According to other advantageous features of certain preferred embodiments of the invention, a peristaltic pump provided in the feed line enables an optimally metered delivery of the zinc electrolyte into the covering so that the liquid quantity necessary for galvanizing is always available. A metering valve which cooperates with the pump would also be possible.

According to other advantageous features of certain preferred embodiments of the invention, the process is so adjusted that the post-galvanization layer adjoins flush the existing zinc layer and is so built up that a further treatment of the sheet metal panels is possible by paint-baking finishing without the occurrence of bubbles or other unevenesses on the painted sheet metal surface.

These and other objects, features and advantages of the present invention will become more apparent from the following description when taken in connection with the accompanying drawings which show, for purposes of illustration only, one embodiment in accordance with the present invention.

Other objects, advantages and novel features of the present invention will become apparent from the following detailed description of the invention when considered in conjunction with the accompanying drawings.

BRIEF DESCRIPTION OF THE DRAWINGS

FIG. 5 is a side partial cross-sectional view of the vibratory tool attached to the treatment element in accordance with a preferred embodiment of the present invention.

DETAILED DESCRIPTION OF THE DRAWINGS

Figure 1:
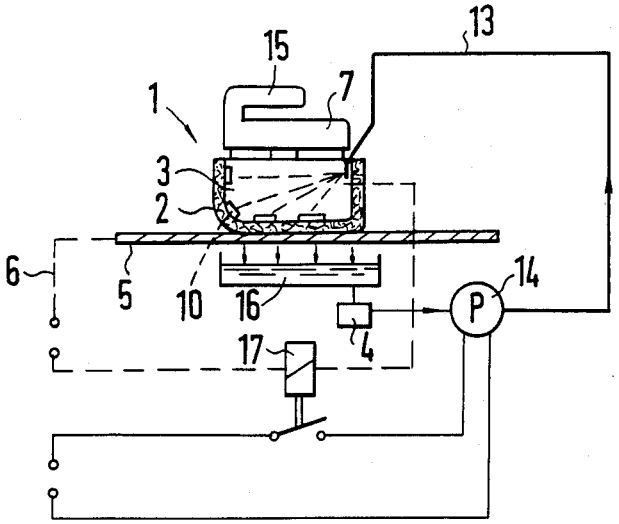
FIG. 1 is a schematic view of the post-galvanizing process in accordance with a preferred embodiment of the present invention.
Figure 2:
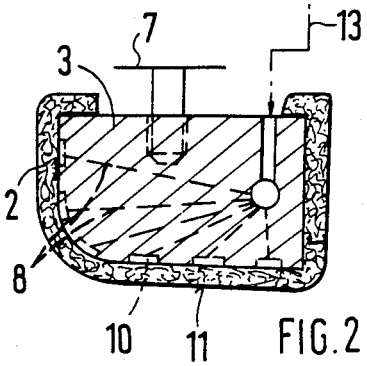
FIG. 2 is a somewhat schematic cross-sectional view through a treatment element of the tool and a schematic side view of the oscillating tool and attachment of the treatment element thereto in accordance with a preferred embodiment of the present invention.

Referring now to the drawings wherein like reference numerals are used throughout the various views to designate like parts, in FIG. 1 the construction of the method for post-galvanizing by means of a manual apparatus generally designated by reference numeral 1 is schematically illustrated. Zinc electrolyte is supplied to an absorbent covering 2, which is retained on the treatment element 3, and is absorbed by the absorbent covering. The treatment element 3 may include materials such as graphite or platinum-plated titanium and forms an anode whereby the material 5 to be galvanized is constructed as a cathode. By contacting the anode with the workpiece 5, the current circuit 6 is closed, and the electrolytic deposition of metal is initiated.

The process is carried out at a voltage of 11 to 13 V and with a current of 10 to 15 A. Prior to galvanizing, the sheet metal surface is cleaned, for which purpose an aqueous alkaline solution with a pH value of about 13 is used. The zinc electrolyte is on an alkaline basis and has a pH value of about 8. The realization of a zinc layer with a thickness of 8 to 12 μm takes place in about two to three minutes. The thus produced average layer thickness can be monitored during the application by an ampere-hour counter and upon reaching the desired layer thickness, a corresponding signal is produced by any conventional means.

The manual apparatus 1 used for carrying out the method includes a lower treatment element 3 and an upper manipulatable hand tool 7 detachably connected with the treatment element. As shown in FIG. 5, an oscillating or vibratory element 20 is integrated in the tool 7. The oscillating or vibratory element imparts to the manual tool an automatic to and fro rubbing movement on the workpiece 5 as shown by arrows A.

As shown in FIG. 5, the oscillating or vibratory elements and attachment to the treatment element can include the type employed in conventional vibratory sanders used as hand tools to sand surfaces. In certain preferred embodiments, the vibratory element includes a rotating motor M attached to a rotating rod 22 which is rotated by the motor as shown by arrow B. The rod 22 is in turn attached to a element 24 such as a disk in an off-center position. The connecting element 24 is in turn attached to an attachment element or rod 26. The attachment element 26 is in turn attached to the treatment element 3 by an attachment ring 28.

When the rotating motor M is rotated, rod 22 rotates as shown by arrow B which in turn produces to and fro movement of the treatment element 3 as shown by arrows A through the attachment elements and the off-center disk 24. The treatment element 3 can be detached from the rotating motor M and thus detached from the manipulatable hand tool 7.

As discussed above, the treatment element 3 forms an anode in operation. The treatment element 3 is attached to the vibratory element 20 of the manipulatable hand tool 7, and the entire combination forms a vibratory rubbing anode device.

In addition to the automatic oscillating movement, the manual apparatus 1 can also be freely displaced in any desired direction by manually manipulating the tool 7 by the handle 15.

Therefore, with the treatment element 3 connected to the oscillating element 20 of the manipulatable hand tool 7, the treatment element 3 is automatically moved relative to the standing-still workpiece 5 and the hand tool 7. This automatic relative movement of the treatment element 3 imparted by the oscillatory element 20 improves the galvanizing by making the coating relatively rapid. Further, in addition to this automatic relative movement, the entire apparatus can be moved as a unit to different positions on the workpiece 5 by manipulating the handle 15 of the manipulatable hand tool 7 attached to the treatment element 3. The entire workpiece is moved to different positions on the workpiece 5, and during contact of the treatment element 3 to the workpiece 5, the treatment element 3 automatically moves relative to the hand tool 7 and the workpiece 5, resulting in excellent galvanizing of the workpiece without requiring tedious and difficult manual rubbing of the workpiece.

Therefore, the operator need only move the entire tool from one area to another, and the tool automatically provides the necessary rubbing motion which results in very effective cleaning or coating without expending as much operator energy and with increased efficiency. The manual movement of the entire tool 1 provides movement of the treatment element in a given direction on the workpiece, and the oscillatory element 20 imparts rubbing motion in at least one additional direction to the manual movement direction.

Figure 3:
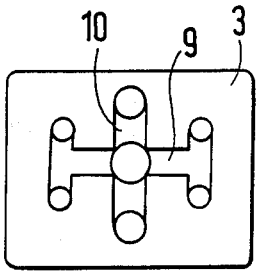
FIG. 3 is a plan view of the working surface of the treatment element in accordance with a preferred embodiment of the invention.

The feed of the zinc electrolyte to the absorbent cover 2 takes place by way of bores 8 which terminate in longitudinal and transverse grooves 9 and 10 (FIG. 3) that are open in the direction toward the cover 2.

Figure 4:
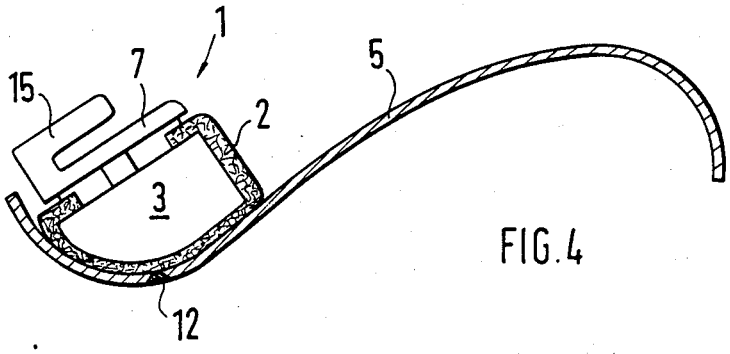
FIG. 4 is a cross-sectional view through a welded-together sheet metal body panel within the area of the fender with the manual apparatus of the present invention put in place for purposes of galvanizing the welding area.

As shown more clearly in FIG. 4, the working surface 11 of the treatment element 3 is matched to the shape configuration of the sheet metal panel 5 so that the area of the welding seam 12 is readily accessible with the element 3. The illustrated shape configuration is shown only as an example. Any other configuration is contemplated by the present invention, for which purpose, the treatment element 3 should be matched to the same.

The post-galvanizing installation essentially includes a collecting tank 16, a line 13 for the zinc electrolyte, a peristaltic pump 14 and an input filter-regeneration-element 4.

The process for galvanizing is carried out in such a manner that the ground surfaces about the welding seam 12 are cleaned electrically whereby the apparatus 1 also includes an absorbent covering to which the cleaning solution is supplied. Thereafter, the post-galvanizing takes place by guiding the hand apparatus 1 with slight pressure over the ground surfaces with simultaneous feed of zinc electrolyte. When the absorbent covering 2 is in contact with the workpiece 5 to be galvanized, the pump 14 is turned on by way of a relay 17 and the electrolytic circulatory system 13 up to the manual apparatus 1 is set into operation. Since the relay circuit is of known type, the line circuits are only schematically illustrated in the drawing. After a deposition process, the ground surface is galvanized and flush with the remaining zinc layer. A painting of the sheet metal surface takes place thereafter without aftertreatment of the zinc layer.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An apparatus for electrolytically treating a surface of a workpiece comprising:

a treatment element having a bottom surface to engage the surface of the workpiece, the treatment element having a plurality of holes therethrough;

an absorbent cover positioned over at least the bottom surface of the treatment element;

connector means for connecting the treatment element to a source of electric current so that the treatment element serves as an anode during use;

a handle assembly for displacing the apparatus over the workpiece as a unit;

means to connect the handle assembly for the treatment element; and drive means in the handle element for imparting an automatic oscillating movement to the treatment element with respect to the handle assembly.

wherein the holes in the treatment element terminate in a plurality of longitudinal and transverse grooves in the bottom surface of the treatment element, the grooves being open in the direction of the absorbent cover, the grooves serving to feed electrolyte to the absorbent cover and being connected with a feed line for the electrolyte and having a bottom side matched to the course of the shape of the surface of the workpiece.

2. The apparatus according to claim 1, further comprising feed line means for supplying electrolyte to the treatment element, said feed line means including a metering pump which is operatively connected with relay means for controlling the engagement and disengagement of the pump as a function of the beginning and end of the galvanizing operation.

3. The apparatus according to claim 2 further comprising a collecting tank and a filter-regeneration element, and wherein said collecting tank, said filter-regeneration element and said feed line means are arranged to recirculate electrolyte to the treatment element.

4. The apparatus according to claim 3, wherein said metering pump is a peristaltic pump.

* * * * *